United States Patent [19]

Zur

[11] 4,287,620

[45] Sep. 8, 1981

[54] MULTI-FEATURE AND VARIABLE FUNCTION BODY SUPPORTING ASSEMBLY AND SIDEGUARDS

[76] Inventor: Henry C. Zur, 10 W. Griswold Ave., Phoenix, Ariz. 85021

[21] Appl. No.: 911,749

[22] Filed: Jun. 2, 1978

[51] Int. Cl.[3] ..... A61G 7/10; F01B 21/00

[52] U.S. Cl. ..... 5/68; 5/62; 5/90; 5/425; 5/446; 5/465; 297/10

[58] Field of Search ..... 5/60, 61, 63, 66–68, 5/90, 424–429, 465, 507–510, 433, 446; 297/DIG. 4, DIG. 10

[56] References Cited

U.S. PATENT DOCUMENTS

| | | | |
|---|---|---|---|
| 866,522 | 9/1907 | Scanlon | 5/507 |
| 2,869,614 | 1/1959 | Wamsley | 5/90 |
| 3,514,794 | 6/1970 | Pofferi | 5/2 R |
| 3,548,426 | 12/1970 | Helton | 5/429 |
| 3,840,924 | 10/1974 | Hamilton | 5/503 |
| 3,879,772 | 4/1975 | Pol | 5/62 |
| 3,978,530 | 9/1976 | Amarantos | 5/66 |
| 4,127,906 | 12/1978 | Zur | 5/90 |

*Primary Examiner*—Casmir A. Nunberg

[57] ABSTRACT

A body supporting assembly composed of pivotally connected supports provided with locking devices which change the functions of the supports and their adjusting means to provide a plurality of positions as may be desired by the occupant for comfort or may be required for various treatments or health reasons. The body supporting assembly is mounted on base members resting on the floor which can be adjusted in relation to the body supporting assembly to facilitate various positioning requirements.

26 Claims, 16 Drawing Figures

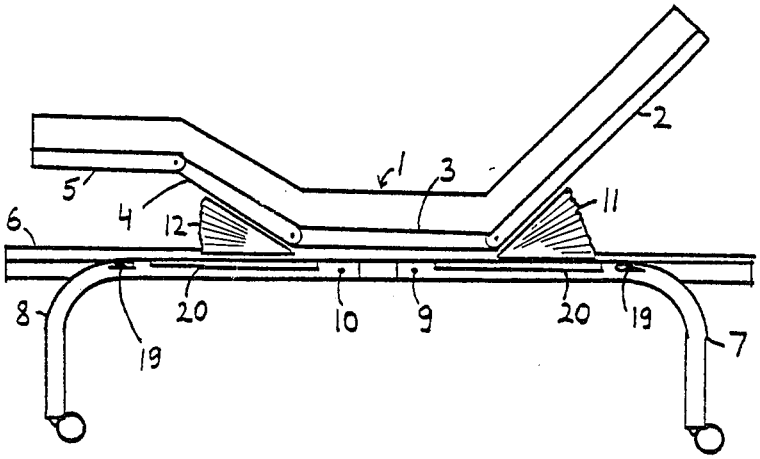
FIG. 1
FIG. 2
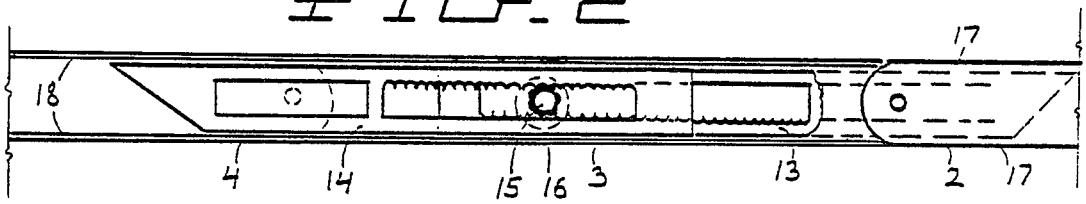
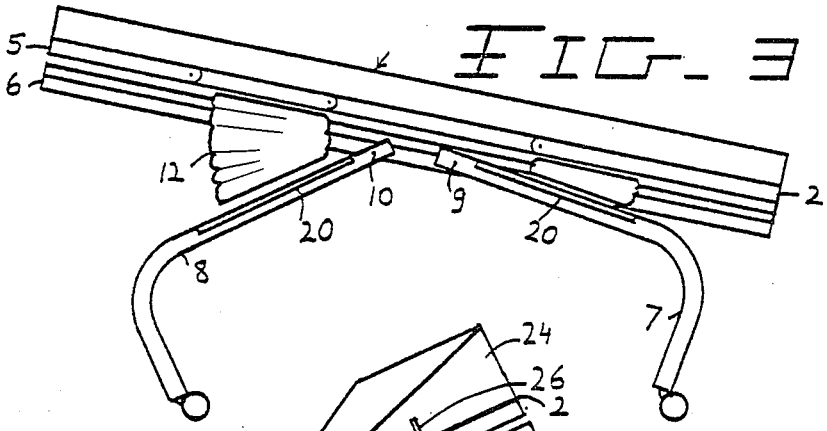
FIG. 3
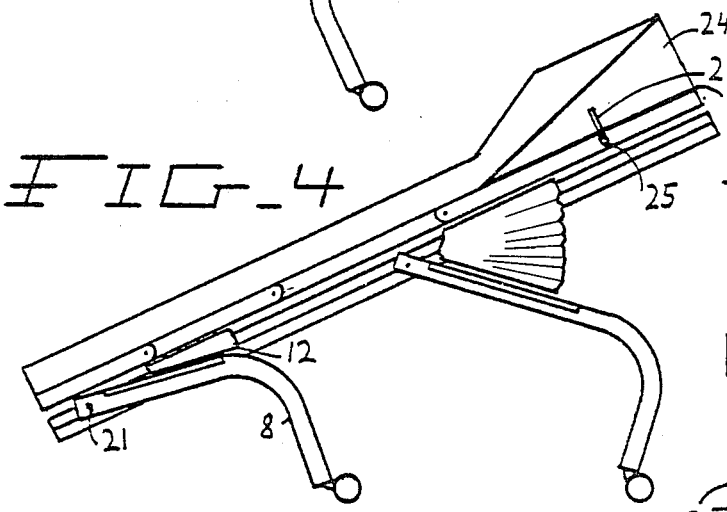
FIG. 4
FIG. 5
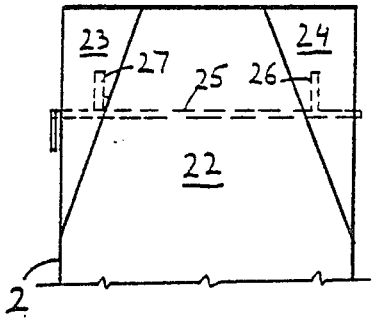

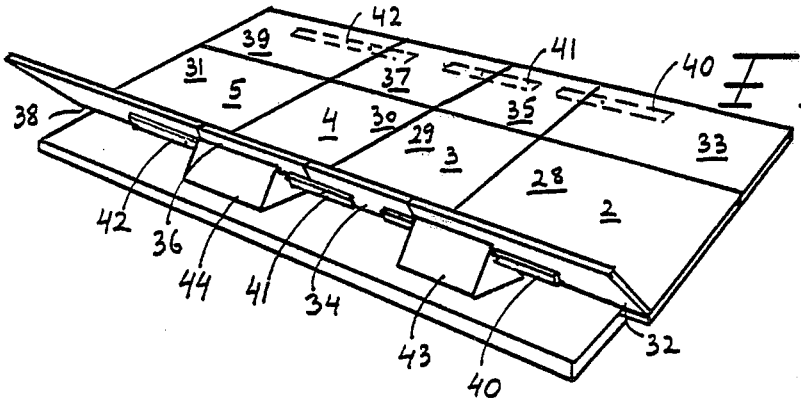
FIG. 6
FIG. 7
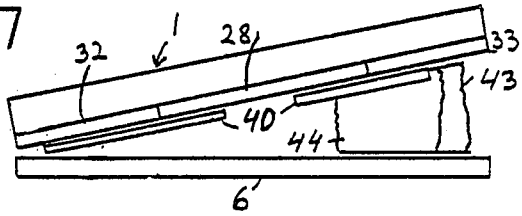
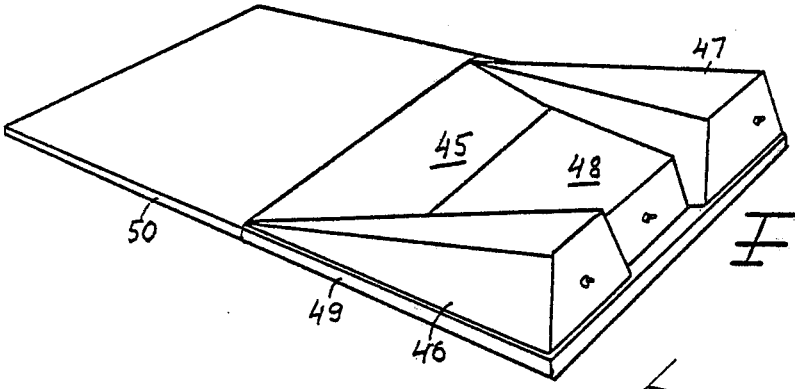
FIG. 8
FIG. 9
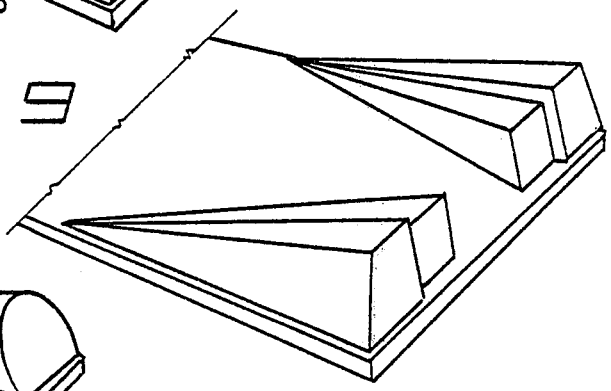
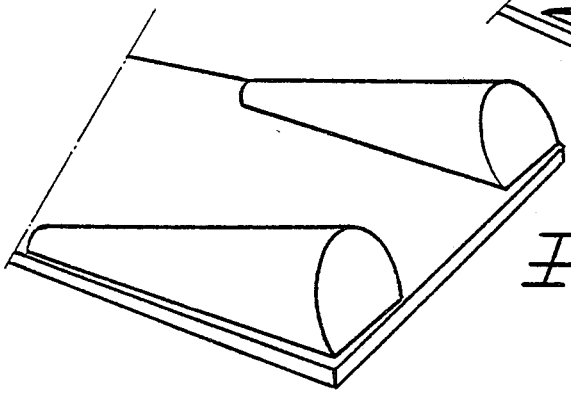
FIG 10

FIG. 11
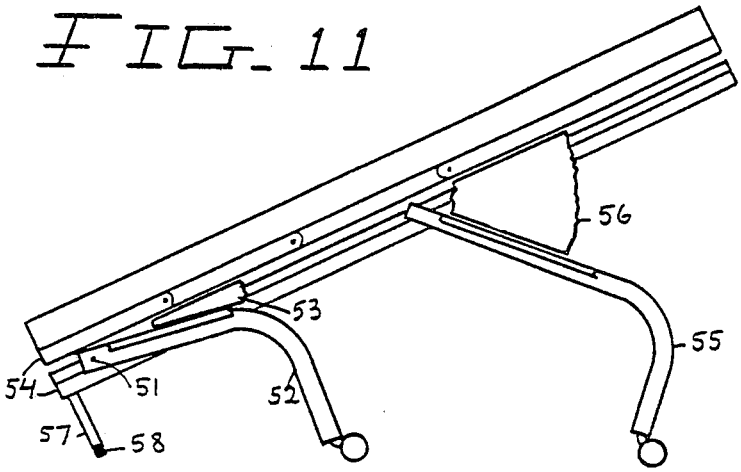
FIG. 12
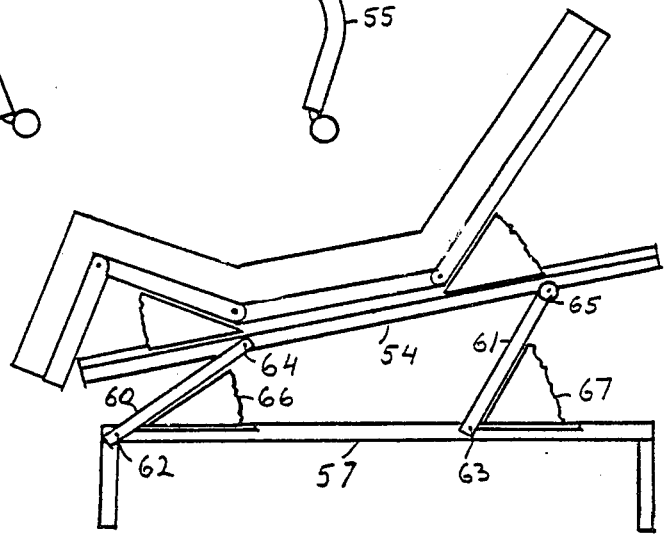
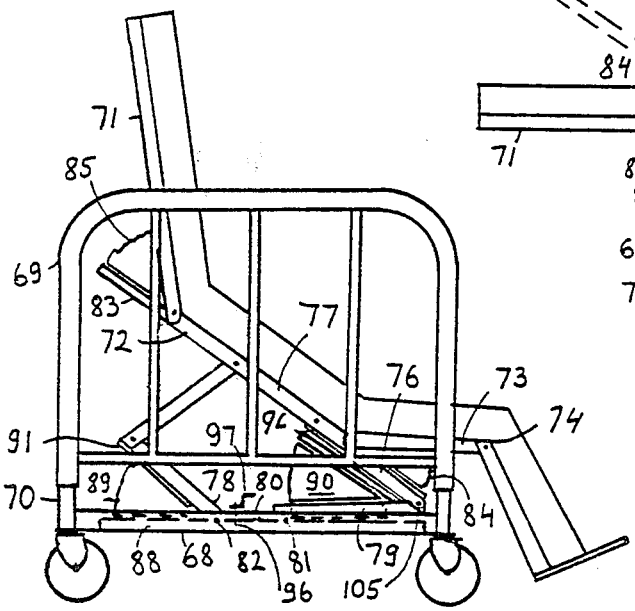
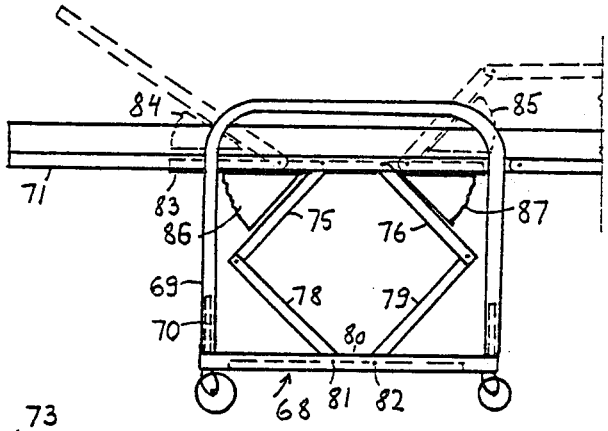
FIG. 13
FIG. 14

MULTI-FEATURE AND VARIABLE FUNCTION BODY SUPPORTING ASSEMBLY AND SIDEGUARDS

In a simplified version, the body supporting assembly is divided both in the transverse and the longitudinal direction, and provided with a locking mechanism composed of bars pivoting below the assembly supports and locking said assembly supports either in transverse alignment or into longitudinal alignment. Locked into the transverse alignment, the body support assembly composed of a back support, a middle support, a knee support and a leg support permits the pivotal movement and adjustment of each transverse part in relation to each other. Locked into a longitudinal alignment, the division of the transverse supports into a middle and two side sections, provides a longitudinal aligned center support with two sides which can be raised by the same adjusting means which usually serve the adjustment of the back and knee supports, such as inflatable bladders positioned below the body supporting assembly, and serve for turning an occupant or as side guards.

Locking the body supporting assembly into a near flat position enables the adjusting means such as inflatable bladders to raise the whole body supporting assembly relative to the base and utilizing the same mechanism provided for adjustment of the body supports in relation to each other.

A variety of functions can be achieved by both the means of locking certain parts of the body supporting assembly into a fixed relation and additional functions can be achieved by means of locking members against which the pressure of inflatable bags is exerted into other positions to divert the pressure and cause a different movement.

Locking the sides of the backsupport, which for that purpose is divided into two sideparts pivotally connected to a larger central part, would provide a simple form of side-guards, when elevated, to eliminate side-rolling of a patient's head. Alternatively, inflatable side-guards, with or without a head-pillow connecting said inflatable side guards, would achieve the same purpose.

The more advanced and multi-function embodiment of this invention provides the body supporting assembly with a locker-type structure, serving both as side-guard and as storage for the very things a bed-bound person needs to have within his reach. This locker-type guard is relatively narrow, to permit the movement of the bed through doors, but is provided with a broader top hinged upward, and to which an extendable table is attached, extending over the bed to serve the person. The locker can be permanently mounted, and in a prefered embodiment, the locker-type side-guard is pivotally mounted at the head-side, and swings outward to provide greater access to bed and person, but it remains within the reach of the person in the bed who can return it and lock it along side the bed.

These locker-type side guards are fitted on one or both sides of the body supporting assembly, and at least one of them is provided with built in controls of all adjustable features, within easy reach of the patient, but also provided with controls shutting certain or all features off, but these are not positioned within the patient's reach. All features operate on fluid, and all controls operate on fluid or alternatively on 12 volt, includng the light fixtures consisting of an attached reading and survey lamp and wall mounted light.

BACKGROUND OF THE INVENTION

A multitude of adjustable body supporting assemblies in the form of hospital beds, wheel-chairs and special functions beds have been developed but for a long time it has been felt, that beds and wheel-chairs could be developed to combine more functions, to provide additional important functions, and that such combination could actually result in making such products more attainable and more widely used. Presently marketed products have only limited features, and are usually operated with a motor driven screw drive for each feature which operate at 110 volt, even when the controls by means of relays are made to work on 16 volt or a similar voltage. This voltage reduction does not eliminate the danger from sparks of the 110 volt motors, only reduce the danger at the controls.

The applicant has been working on the development of more-featured body supporting assemblies which could provide a safer and more practical operation and reduce production costs relatively for some time and filed patent applications in regard to certain developments, and a number of disclosure documents in regard to additional developments, which are mainly the subjects of this application, and are based on work and ideas formed in 1976 and 1977.

The applicant has always felt that certain necessities have been neglected, such as for example that hospital beds make no provisions to keep an occupant's head in a proper position, and not to have his head dangerously rolling to the side, especially when falling asleep on an elevated backsupport. Also that more functions could be provided without additional costs by locking devices which would make the same adjusting means perform different functions, and that more comfort could be provided, including better sitting up positions which presently require the transfer of a patient to a chair, and more mobility so that the same bed could serve a sick or handicapped person for various tasks. And that it should include a locker-type side-guard servng as extendable table and to store the necessities of a patient, swinging outward for better access, of service personnel and doctors, but still within the reach of the patient to swing the locker back to a position parallel with the bed. This will finally eliminate the many inconveniences caused to bed-bound persons by attending personnel and others, who move for some reason or other the bed-tables aside without returning them to the bed-side.

Obviously, the present state of the art has not suuficiently eliminated the dangers from the usually used electric current of 110 Volt. Because of the lack of less dangerous equipment, hospitals have accepted and use equipment for hospital rooms, operated on said current of 110 volt, which poses quite a danger, especially as oxygen breathing equipment has very often to be applied to patients in said rooms. In some equipment the hand controls have been reduced to pneumatics or 16 volts, but the motors operate on 110 V.

An very important problem, and a handicap to convalescence is the present absence of convalescent-related comfort in hospital beds. A confinement to a hospital bed weakens a person's muscles, and requires periods of convalescence in sitting up and walking. Since the present hospital beds do not provide any means for properly sitting up, and helping a person into an upright position, this requires presently the attendance of hospital personnel, carrying a person out to a chain, or standing him up for a walk, and this also when-ever such person needs to go to the bathroom. Under the present ever rising cost of hospitalization, such services are perforce held to a bare minimum, thereby actually prolonging the convalescence of a patient. A bed as provided by this invention, would permit a person to sit up by himself, to stand up by himself, and in its sitting position to be rolled out with the patient into the air or courts, being in this state very compact, and capable to incorporate some motorised mobility for self-operation.

OBJECTS OF THE INVENTION

Taken into account shortcomings of adjustable body supporting assemblies, the following are the objects of this invention:

1. To provide a body supporting assembly which can both serve with pivoting parts, or be locked into any desired fixed position.
2. To provide a body supporting assembly with pivotally connected supports, which can both be locked to function in transverse or longitudinal alignment.
3. To provide a body supporting assembly composed of pivotally connected supports with the capability to serve as side guards by having side portions locked into a fixed position.
4. To provide a side guard forming structure, which can be fastened to a body supporting assembly, and serve especially to restrain a person's head from falling sideward on an elevated backsupport.
5. To provide side guards in the form of lockers for holding a bedbounds person's needs, and make them swingable for better access by attending personnel.
6. To provide said lockers with extendable table-tops.
7. To provide said lockers with built in controls to operate the features of the bed and bell and light fixtures.
8. To provide said locker type side guard with a flexible arm-mounted reading and survey lamp, operated by a dimmer type switch to reduce disturbing light to others and serve examining personnel as projector type survey lamp.
9. To privide a body supporting assembly which can be changed safely from regular or elevated positions to a vertically slanted position to facilitate the entry or exit of a person.
10. To provide body supporting assemblies and the complementary room equipment with a maximum of safety by operating all adjustable features by fluid controls directly or in combination with low electric current controls, and to provide all additional fixtures working on low current.
11. To provide a body supporting assembly serving a sick person with a combination reading and examining projector, preferably mounted on a long flexible arm, to reduce the obstruction to others in the room, and to serve for better local treatment.

DESCRIPTION OF THE DRAWINGS

FIG. 1 is a sectional side view of an simplified embodiment, wherein the base members are aligned and locked with the panel, thereby causing the inflated bags to elevate the back and knee supports.

FIG. 2 is a sectional view of the device locking the backsupport and the knee support into a fixed and aligned position with the panel.

FIG. 3 is a sectional view of the embodiment of FIG. 1, showing how the inflation of the same bladders causes the base members to move downward and thereby elevate the whole assembly as selected.

FIG. 4 is a sectional view of a similar embodiment, wherein the foot-side base member is pivoted at the foot end of the panel to provide a more vertical slant for entry or exit of a person, and wherein side members of a divided back support are swung upward to serve as guards.

FIG. 5 shows a divided back-support.

FIG. 6 is a perspective view of a pivotal connected body supporting assembly capable to assume both transverse or longitudinal divisions, and showing one longitudinal side partially pivoted upward.

FIG. 7 is a view of a locked body supporting assembly assuming a transverse slant.

FIG. 8 is a perspective view of a side guard forming feature mounted on the upper half of a body supporting panel.

FIGS. 9 and 10 are perspective views of variations of the side guard feature FIG. 11 is a sectional view of a variation of the embodiment shown in FIG. 4 but with the addition of fixed legs extending at the foot end downward to provide a safer hold when the assembly is elevated vetically slanted for entry or exit of a person.

FIG. 12 is a sectional view of the embodiment with a fixed base and the selective elevation of the panel mounted body supporting assembly by means of a fixed linking at one side and variable linking at the other side.

FIG. 13 is a sectional side view of an embodiment with two pairs of fixedly connected links connecting the base with the body support panel and inflatable bladders pressing against said links to achieve achieve elevation.

FIG. 14 is a sectional side view showing how a sitting up position is achieved by a variation of the embodiment shown in FIG. 13, but with the inflatable bladders serving for elevation positioned below the lower linking members and the base, and an additional bladder positioned between the foot near side lower linking member and the upper linking member to achieve a vertical slant position.

DESCRIPTIONS OF PREFERED EMBODIMENTS

Simplified Embodiment

Figure 15:
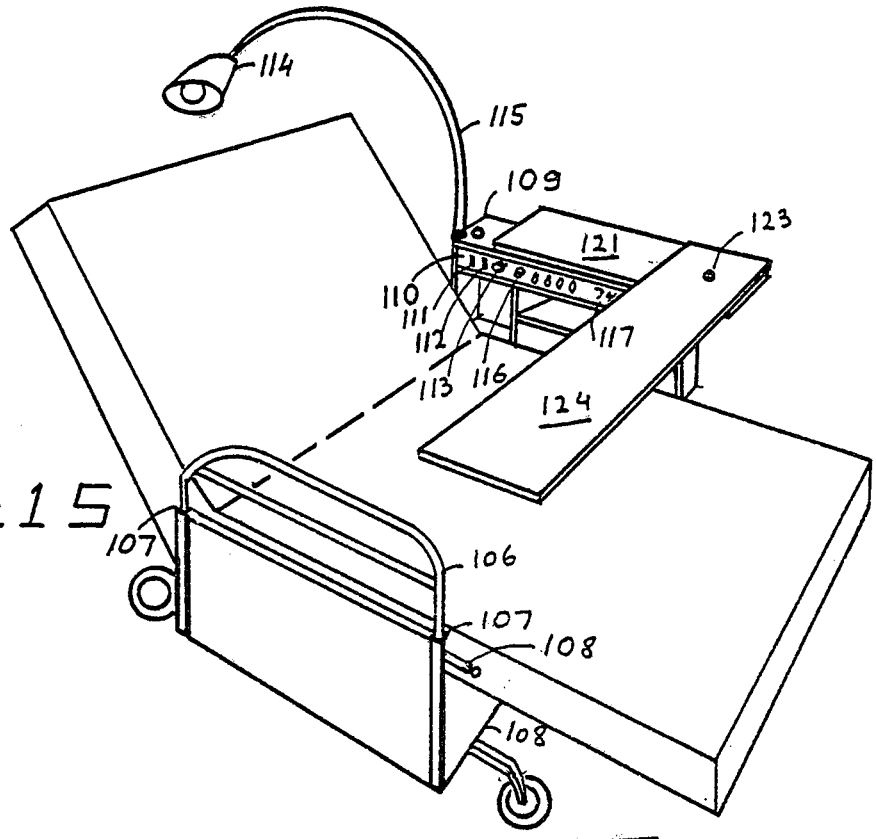
FIG. 15 is a perspective view of the assembly with one adjustable sidegard and one locker-type side guard with its pivoting tables and the control panel to operate all features and fixtures.

A very rational and relative low production cost embodiment is shown in FIGS. 1, 2 and 3. A body supporting assembly 1, composed of a backsupport 2, a middle support 3 a knee support 4 and a leg support 5 is resting on a panel 6 to which two base members 7 and 8 are pivotally mounted at 9, and 10. Two inflatable bladders 11 and 12 serve for the adjustable elevation of the back support 2 and the knee support 4. A locking device in the form of two bars on each side of the panel shown as 13 and 14 are provided with teeth which lock on each side into geared wheel 15 which moves the bars outside when knob 16 is turned in one direction, and moves the same bars back when knob 16 is turned into the other direction. the outward moving bars engage into the side members 17 of the back support 2 and into the side members 18 of the knee support 4, and thereby locking both supports into a fixed relation in regard to the middle support 3, and at the same time pulling a cable retracting bolts 19 which were holding the base members 7 and 8 in a fixed position in regard to the panel 6. Now the inflatable bladders 11 and 12 which are mounted on a board 20 mounted on each base member serve instead of elevating the back or knee support, to elevate the fixed assembly in any desired slanting or elevating position by means of inflating each bladder separately or both bladders together.

A variation of this embodiment is shown in FIG. 4 and 5. The base member 8 has been mounted to the panel 6 at 21, and the pressure exerted by the inflatable bladder 12 serves to elevate the bed into a more vertical position to facilitate the entry or exit of a handicapped person. The back support 2 is divided into a main section 22 and two side sections 23 and 24, which are pivotally connected to 22 and serve as elevating side flaps when locked into an upward position by means of a rotating bar 25 with support arms 26 and 27.

Combination Embodiment for Transverse and Longitudinal Adjustments

A body supporting assembly divided both in the transverse and the longitudinal direction is shown in FIG. 6. The transverse supports 2,3, 4 and 5 are each subdivided into 3 sections. The center sections 28, 29, 30 and 31 are pivotally connected to their respective side sections 32, 33, 34, 35, 36, 37 38 and 39. Rotatable bars 40,41 and 42 have been rotated to provide a longitudinal alignment and division of the whole body supporting assembly, an elevated longitudinal section serving as side guard to position a patient. The elevation is accomplished by inflating the bladders 43 and 44 positioned on one side. These bladders serve also to provide a transverse slant to the whole body supporting assembly when locked into a fixed position as shown in FIG. 7, and serve together with a second pair of inflatable bladders positioned on the other side for the respective adjustment of the back support and the knee support, thereby performing different functions, when operated against one of the parts locked into a fixed position.

Side Guard Features

Utilizing the operation of the body supporting assembly by means of fluid under pressure, an additional important feature is added as shown in FIG. 8. This additional feature 45 is composed of two elongated inflatable pillows 46 and 47 connected by inflatable pillow 48, and serves besides being an adjustable headrest, as adjustable side guards, eliminating the fall or incline or a person's head, occuring quite often when persons fall asleep on an adjustable body supporting assembly with the back support elevated. The side guard pillows 46 and 47 are here shown mounted together with pillow 48 on a slip cover 49 which has been slipped over the head of the mattress 50 and thus securely positioned. The side guards 46 and 47 can be preformed to inflate to a desired shape, or have parallel inflatable pillows as shown in FIG. 9, without a connecting pillow, or made of upholsterey materials such as foam as shown in FIG. 10.

Embodiments With Floor Holding Safe Guards

A variation of the simplified embodiment previously described is shown in FIG. 11. The base member serving the footside has been shortened and is pivoted at 51, thereby causing the base member 52 to provide an downward movement when the inflatable bladder 53 mounted against panel 54 is inflated. If the headside base member 55 has previously been moved downward by inflatable bladder 56, or this is done simultaneously, the panel 54 assumes a slanting position facilitating the entry or exit from the body supporting assembly. As safe guards against the movement of the whole assembly lockable wheels can be utilized or as shown here two legs extend from the panel 54, and hit the floor once the whole assembly has assumed a slanted position in this direction.

The detailed safe guard feature is shown in FIG. 11. A fixed leg extend from the member 54. This leg 57 dimensioned to be above the floor level when base member 52 is in a horizontal position. However, once the base member is moved downward, the fixed leg hits the ground and by virtue of a holding portion 58 such as rubber, is prevented from slipping, and thus provides a fixed point against which the other base member moves.

A further variation of the embodiment shown in FIG. 11, is shown in FIG. 12. An additional panel 59 has been added serving as base with legs extending to the floor. Instead of the members moving on the floor, this assembly is provided with members 60 and 61, pivoted respectively to the base panel at 62 and 63 and member 60 is also pivoted at 64 to the panel 54 while member 61 is provided with wheels 65 which permit the member to make a a variable movement. Thus as shown the inflation of the bladder 66 positioned between the panel 59 and the member 60 can cause this side to be elevated, inflation of bladder 67 positioned between member 61 and panel 59 can cause the other side to be elevated, and inflation of both bags simultaneously will cause the whole assembly to elevate.

Multi Feature Hospital Type Embodiment

A most versatile embodiment of this invention is shown in FIG. 13. A relative small square base 68 is supported on wheels resting on the floor. The base sides extend directly upward, combining with other components to serve as side guards, or as shown here the side guard 69 structure is mounted with tubular components sliding over the upward extending legs 70. The body supporting assembly composed of pivotally connected supports 71,72,73 and 74 is mounted with its middle support 72 to members 75 and 76 permitting a pivotal movement in regard to side member 77 of the support 72. Similarely, members 75 snd 76 are pivotally mounted to the other side member of support 72. These members 75 and 76 are in turn pivotally mounted to members 78 and 79 extending downward to the center of the side rails 80 of the base 68 and pivoted at 81 and 82. A panel 83 is mounted to the bottom of the support 72 and inflatable bladders 84 and 85 are placed between this panel and the back support 71 and the knee support 73 and serve for adjustment of these supports in relation to the middle support 72. Two additional bladders 86 and 87 are positioned between the 68 and the members 75 and 76 respectively, and provide by inflation for adjustment of panel 83 in relation to the base, and thus permit any desired positioning of a patient in the longitudinal direction. The body supporting assembly can be raised as shown in FIG. 13 for treatment or checkup, and unless the guards are especially raised, they will remain low and not obstruct any action by attending personnel. Controls of this embodiment can be divided in patient operated features such as the adjustment of the various body supports, and the controls for elevating and slanting can placed out of reach of the occupant or accessable by locked means.

A further variation of the above described embodiment is shown in FIG. 14. Two inflatable bladders have been positioned below 78,79 on base 68 and serve for horizontal or partial slanted elevation of middle support 72. To achieve a more vertical slanted position to facilitate sitting up or exiting, inflation is switched from the bladder positioned below member 79 to an additional bladder positioned between members 79 and 76, causing a forward slant.

Hospital Type Embodiment with Variable Positioning, Safety and Comfort Features

Turning now to FIG. 15, a variation of the embodiment shown previously in FIG. 14, and operating for variable positioning in the same manner is presented with different side guards. One one side, a removable side guard structure 106 is inserted in tubes 107 extending from members of the base frame 108, and can be variable adjusted for height and held by a spring-bolt assembly 108 in the selected position. On the other side a locker-type structure 109 is pivotally mounted on one tube 107 extending from members of the base, same as 107 on the first described side, and can be locked into a position parallel to the bed by means such as insertion of a rod into the other tube 107. The locker is divided by shelves to accomodate various neccesities of a bed-bound person, and has a control panel 110, on which the controls of the various features for positioning are mounted, together with control switches 111 and 112 for wall or ceiling mounted light fixtures, and a dimmer-type switch 113 for a special reading and surveying projector 114 mounted with a flexible arm 115 onto the locker, and a bell knob 116 which is lit up when pushed on to summone a nurse, and pushed off, when help is no longer called for and other features such as a clock 117 and a built in loudspeaker 118, which also as a combination microphone and for talks with outside positioned personnel.

Figure 16:
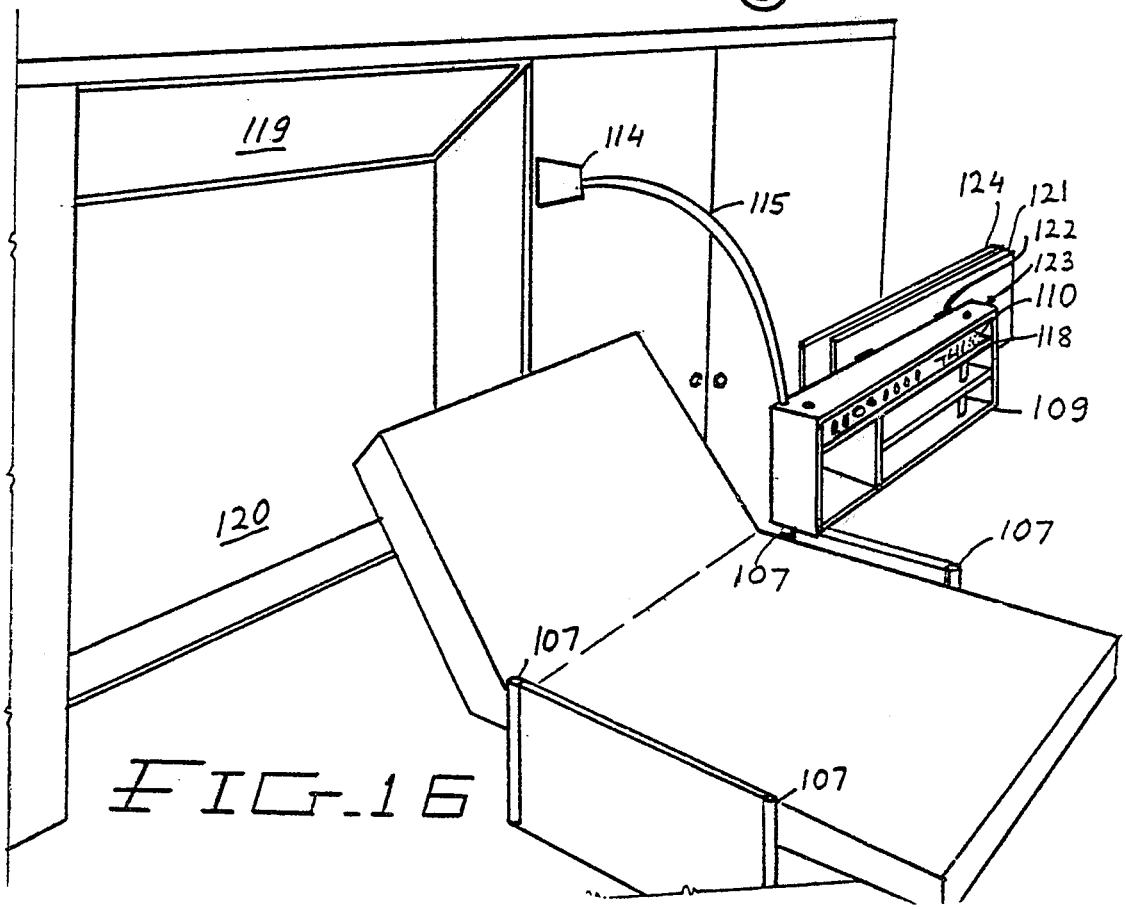
FIG. 16 shows the assembly in plan with the locker-type side guard swung open to provide greater access to attending personnel.

The projector 114 can be adjusted by means of its long and flexible arm 115 into any desired position and its light intensified by means of the dimmer 113 and directed to illuminate a certain part of a patients body which has to be attended to. A wide locker-top 121 is shown in different positions in FIG. 15 16, mounted onto the locker 109 with a pivotal mounting 122 and is provided with an additional table 124 which can be swung out over the bed, being mounted onto the locker-top by means of a pivotal mounting 123. Both the top 121 and the table 124 can resume a vertical position shown. FIG. 16 shows the locker swung open. To reduce the dangers from regular 110 voltage electricity all fixtures including the fluorescent wall or ceiling mounted fixtures 119, shown here in FIG. 16 as part of a wall-system 120, and all the controls in the locker 109, and the whole operating system, of FIG. 14, operate on a 12 Volt or lower current fed from an outside positioned transformator.

What I claim is:

1. A adjustable body support assembly composed of six or more pivotally connected support panels, adjustable in relation to each other and provided with power means and or locking mechanisms such as pivotally mounted rotating bars serving to hold two or more supports support panels in fixed relationship, and wherein said body support panels form a body support area serving for the adjustable positioning with the support panels forming into transverse divisions and or longitudinal division and wherein alternatively raised portions of the subdivided transverse divisions formed by two or more support panels can provide longitudinal divided supports and serve for other purposes such as providing a turning movement to an occupants body or such as restraining the sideward movement of body portions.

2. The body supporting assembly of claim 1, wherein the assembly is both transversely and longitudinally dividable into desired fixed relations, being composed of pivotally connected supports.

3. The body supporting assembly of claim 1, wherein the adjusting means such as inflatable bladders provide different functions of adjustment to an occupant, having selected the body supporting assembly in desired fixed relationship.

4. The body supporting assembly of claim 1, provided with base members which are extending to the floor.

5. The body supporting assembly of claim 1 wherein the support panels are locked into a fixed relationship of longitudinal alignment, and the power means provided for the adjustable elevation of the back support panels and the knee support panels, while these are locked for transverse alignment, serves alternatively for the adjustable elevation of said in longitudinal alignment locked support panels, providing the occupant with a movement from side to side.

6. A body supporting assembly composed of an upper portion with body support panels and a lower portion having two base members with legs extending to the floor wherein base members are pivotally connected to members of said upper portion of the body supporting assembly which can be adjusted for slant or elevation in relation to the floor by an upward or downward movement of a pivotally mounted base member caused by lifting means mounted between said upper portion and said base member to provide the desired movement of the pivotally mounted base member such as selective inflation or deflation of inflatable bladders placed between said upper portion and said base member.

7. The assembly of claim 6 wherein the means serving for the adjustable elevation of a body support panel mounted between a member of said upper portion and said support panel can be diverted to cause a downward or upward movement of a base member by means such as levers or locking devices diverting the movement from said support panel to said base member.

8. A surface layer having side forming walls to restrain and hold the upper body parts of a person reclining against an elevated back support, composed of two elongated side walls said side forming walls provided with holding means, such as a draw-over cover to be drawn over a mattress or back support, to which said side walls are fastened.

9. The side guard structure of claim 8, wherein the walls are made of resilient material.

10. The side-guard structure of claim 8, wherein the side guards are formed as inflatable bladders, shaped to restrain an occupants head or upper body moving to much outward.

11. The side-guard structure of claim 10, wherein the inflatable bladders serving as side-walls are connected by an inflatable bladder serving as a head-pillow.

12. A body support assembly composed of an upper assembly comprising three or more pivotally connected support panels adjustable in relation to each other and a lower assembly composed of a base and pairs of pivotally connected members serving for an adjustable positioning of said upper assembly on said lower assembly and wherein each such pair composed of pivotally connected members is consisting of an upper member which is pivotally connected with its other end to a member of the upper assembly and a lower member pivotally connected with its other end to a member of the base, and provided for the purpose of an adjustable elevation or slant of the upper assembly in relation to the base, with lifting means to cause movement of upper members and lower members of said pairs, such as selective inflation of inflatable bladders mounted between said pivotally connected members, or between said pivotally connected members and the upper assembly or the base.

13. The body supporting assembly of claim 12, wherein one or more inflatable bladders are positioned on sides of the base structure to provide an upward movement of the lower member pivotally connected to the base structure, thereby serving to elevate the upper assembly through the pivotally connected upper members, and wherein an additional inflatable bladder or number of bladders is or are positioned between the upper and the lower pivotally connected members or the said upper member and the upper assembly and which when selectively inflated cause the selected elevation or slant of said upper assembly, and which when only bladders positioned on one side are selectively inflated causes the said upper assembly to pivot at the pivotal connection of said lower members to said upper members at the opposing side of the base and to assume a more upward slanted position supported by the inflation of bladders positioned at the other side.

14. The body supporting assembly of claim 12 wherein movement causing means have been mounted between said upper and said lower pivotally connected members.

15. The body supporting assembly of claim 12 wherein movement causing means have been mounted between the said pivotally connected upper members and the said upper assembly.

16. The body supporting assembly of claim 12 wherein a number of movement causing means have been mounted between the said pivotally connected members and the upper assembly and base to provide for the selected position or slant of the said upper assembly.

17. The assembly of claim 12, wherein the upper assembly is composed of pivotaly connected support panels, each provided with lifting means for separate adjustment in relation to each other.

18. The body supporting assembly of claim 6 or 12 wherein the upper assembly pivots into a slanting position, pivoting at the pivotal connection of said upper members and said lower members, when the lifting means for the opposing side only are activated, thus causing the lower member at the other side to remain aligned with the base and the upper member to align with members of the said upper assembly to which it is pivotally connected, and thereby achieving the slant required to facilitate sitting up or getting in and out of the body supporting assembly.

19. The assembly of claim 1 or 6 or 12, wherein the support panels forming the back support is composed of one main center support panel and two, from said center panel, sideward extending support panels which can be raised to form and serve as side guards to restrain the head and upper body of an occupant from falling sideward while on an elevated back support.

20. The assembly of claim 1 or 6 or 12 wherein a combination side guard and cabinet type is pivotally mounted to a side of the assembly, capable to swing outward to provide greater access for service and treatment, or to remain in a fixed position locked to stay alongside a middle portion of the assembly in order to restrain an occupant from falling off said assembly and to be within easy reach of a sick person's hand, while said person is laying flat or on a raised back support, so as to unable such person to operate any controls which may be located in said cabinet type structure or to reach for any necessities or books placed there.

21. The assembly of claim 20, wherein the base is provided at both sides of the body supporting assembly with pivots for mounting cabinet-type side guards, so that the cabinet-type side guard can be positioned on the side convinient for the occupant, and a frame-type side guard positioned on the other side, adjustable and removable.

22. The assembly of claim 20, wherein the cabinet-type structure is provided with a wider top, mounted to swing upright into an out of the way position to keep the whole assembly as narrow as possible for movement through halls and doors.

23. The assembly of claim 20, wherein an additional table top is removably mounted on the cabinet structure, and by means such as a pivotal connection can be swung out over the body supporting assembly to serve for reading, writing or eating.

24. The assembly of claim 20, wherein the various controls of the features of the assembly are built in into the cabinet-type structure, and are operated for safety purposes by fluid operated controls to adjust and activate the various features, eliminating the dangers of electricity and sparks.

25. The assembly of claim 20, wherein a reading lamp with a flexible arm is mounted on the cabinet-type structure, serving both as projector for localized examination or treatment, and as variable reading lamp, to reduce the discomfort caused to others by strong lights in the room.

26. The assembly of claim 1 or 6 or 12, wherein the support panel serving as leg support is provided with movement causing means capable to provide a downward movement of the said pivoting leg support in order to position an occupant's feet below the level of the other support panels and near the floor to facilitate sitting up and getting in and out of the assembly.

* * * * *